US006053644A

United States Patent [19]

Nakamura

[11] Patent Number: 6,053,644

[45] Date of Patent: Apr. 25, 2000

[54] CLIP AND HANGER FOR SHEET-LIKE PHOTOSENSITIVE MATERIAL

[75] Inventor: Takashi Nakamura, Kanagawa, Japan

[73] Assignee: Fuji Photo Film Co., Ltd., Kanagawa, Japan

[21] Appl. No.: 09/109,937

[22] Filed: Jul. 2, 1998

[30] Foreign Application Priority Data

Jul. 4, 1997 [JP] Japan ..... 9-194811
Oct. 31, 1997 [JP] Japan ..... 9-316186

[51] Int. Cl.[7] ..... G03D 13/08; G03D 13/10

[52] U.S. Cl. ..... 396/647; 396/652; 396/653

[58] Field of Search ..... 396/651–653, 396/647, 699, 654; 378/168, 169, 170; D8/72, 395; D19/65; 24/497, 338, 458; 226/90–92; 248/346.04

[56] References Cited

U.S. PATENT DOCUMENTS

| | | | |
|---|---|---|---|
| 2,092,522 | 9/1937 | Post | 396/649 |
| 2,289,412 | 7/1942 | Dye | 396/653 |
| 2,502,890 | 4/1950 | Ruschmann | 396/652 |
| 2,509,293 | 5/1950 | Friedman | 396/649 |
| 2,535,728 | 12/1950 | Eisner | 396/652 |
| 3,374,353 | 3/1968 | Saffir | 396/652 |
| 3,415,177 | 12/1968 | Abramowitz et al. | 396/652 |
| 3,683,782 | 8/1972 | Rinn et al. | 396/652 |
| 4,192,602 | 3/1980 | Lamoreaux et al. | 396/647 |

FOREIGN PATENT DOCUMENTS

| | | | |
|---|---|---|---|
| 50-136425 | 4/1949 | Japan . | |
| 50-136426 | 4/1949 | Japan . | |
| 57-66496 | 10/1955 | Japan . | |
| 49-21146 | 2/1974 | Japan | 646/23 |
| 51-117633 | 10/1976 | Japan | G03D 13/10 |
| 6-27628 | 2/1994 | Japan | 396/FOR 970 |
| 7-295191 | 11/1995 | Japan | G03D 13/10 |
| 7-319138 | 12/1995 | Japan | 396/FOR 970 |
| 10-10698 | 1/1998 | Japan | G03D 13/10 |
| 10-73909 | 3/1998 | Japan | G03D 3/08 |

*Primary Examiner*—D. Rutledge
*Attorney, Agent, or Firm*—Sughrue, Mion, Zinn, Macpeak & Seas, PLLC

[57] ABSTRACT

A sheet-like photosensitive material clip for use in a hanger-type film processor, in which the clip has a pair of opposite forward end portions for clipping a sheet-like photosensitive material therebetween, in which a photosensitive material contacting portion at one of the forward end portions is formed to be planar, while a photosensitive material contacting portion of the other forward end portion is formed like dentition having a plurality of teeth formed in zigzags.

17 Claims, 5 Drawing Sheets

CLIP AND HANGER FOR SHEET-LIKE PHOTOSENSITIVE MATERIAL

BACKGROUND OF THE INVENTION

The present invention relates to a sheet-like photosensitive material clip, a sheet-like photosensitive material hanger, and a sheet-like photosensitive material for use for processing a photosensitive material, and more in detail, relates to a sheet-like photosensitive material clip, a sheet-like photosensitive material, and a sheet-like photosensitive material hanger in use for performing hanger-type film developing (dip and dunk film processing).

A photographic film (for example, a color reversal film, etc.) which is a photosensitive material, a subject of the present invention, is a so-called silver-salt photographic sensitive material formed through a process in which fine crystal of silver halide such as silver chloride, silver bromide, or the like, and sensitizing dye are mixed with each other and dispersed in a gelatin solution to obtain photosensitive emulsion, and the emulsion is applied to a support to a very fine thickness, and then the thus coated support is dried.

Hanger-type film developing is of the type in which a photographic film hung by means of a photosensitive material supporting tool is immersed, together with the photosensitive material supporting tool, successively into processing tanks in which various processing solutions are stored respectively so as to carry out the various processings on the film. The apparatus therefor is called a hanger-type film processor (usually, an automatic developing processor).

A hanger-type film processor the advantage that various sizes of films can be developed by one developing processor if hangers and clips are devised. Generally, the hanger-type film processor is used particularly for color reversal films which are different in kind of processing, time for development (sensitizing processing, desensitizing processing) and which are different also in shape and size. The hangers and clips, therefore, have been improved variously in accordance with the shape and size of films to be processed.

Hangers are known as disclosed, for example, in the Unexamined Japanese Patent Application Publication Nos. Sho 49-21146 and Sho 51-117633; and Hei 7-295191, the Japanese Patent Application No. Hei 8-186581, etc. Clips are known as disclosed, for example, in the Unexamined Japanese Utility Model Application Publication Nos. Sho 50-136426; Sho 50-136425 and Sho 57-66496, the Japanese Patent Application No. Hei 8-186580, etc.

The contents of those patent or utility model applications, however, relate to roll films (particularly, roll films for a so-called new photographic system) and in those applications, hangers and clips are proposed which become less dirty in processing (the back surface becomes less dirty so as not to interfere with magnetic reading).

Among photographic films, on the other hand, there are sheet films having sizes of 4×5 (inch), 8×10 (inch), and the like. A hanger to be used for such sheet films has a substantially parallelogram supporting frame so that four corners of a sheet film are clipped and held by four clips attached on the frame. In the foregoing conventional clip, each of a pair of opposite forward end portions for clipping a film therebetween is formed to be like a dentition having a plurality of teeth formed in zigzags. Conventionally, therefore, uneven marks were always formed by the teeth of the clips in the four corners of a sheet film subjected to development. Further, there is a problem that a processing solution drops from the highest clip, and that uneven developing is apt to be caused.

Conventionally, consideration was scarcely given to the hangers used for sheet films. Such a sheet film, however, is used for high-class photography because of its large picture size. Further, since a photographed and developed film is used as a print original, the film is frequently color-decomposed through a color scanner to thereby obtain a printing plate to be used for printing. At this time, the uneven marks due to the clips cause the adhesion of the color scanner to a cylinder so that the printing picture quality is lowered in those portions. Such a disadvantage is caused overwhelmingly frequently in the case of color reversal film processing rather than in the case of color negative film processing.

Further, in the case of color reversal film processing, the problem exists that the number of processing steps is large, and a preceding processing solution is apt to drop from the positions of the clips to thereby cause uneven developing when a film is immersed from a reversing bath into a reversal color developer in hanger-type developing (dip and dunk film processing). This problem is important particularly in the case of the foregoing silver salt photographic sensitive material.

SUMMARY OF THE INVENTION

Therefore, a first object of the present invention is to provide a sheet-like photosensitive material clip by which such an uneven clip mark as described above is not formed.

Further, a second object of the present invention is to provide a sheet-like photosensitive material hanger by which such uneven developing due to dropping of a preceding processing solution as described above can virtually always be prevented from being generated and a sheet-like photosensitive material is suitable for the hanger.

The first and second objects can be achieved by the following items (1)–(6) according to the present invention.

(1) A sheet-like photosensitive material clip for use in a hanger-type film processor, characterized in that the clip has a pair of opposite forward end portions for clipping a sheet-like photosensitive material therebetween, in which a photosensitive material contacting portion at one of the forward end portions is formed to be planar, while a photosensitive material contacting portion of the other forward end portion is formed like a dentition having a plurality of teeth formed in zigzags.

(2) A sheet-like photosensitive material clip according to the item (1), in which a stopper is formed so as to prevent a photosensitive material from entering the inside of the clip.

(3) A sheet-like photosensitive material clip according to the item (1) or (2), in which a top end angle of each of the teeth is selected to be not larger than 60°, and the number of the teeth is selected to be 2 to 4.

(4) A sheet-like photosensitive material hanger having a photosensitive material supporting frame for obliquely supporting a sheet-like photosensitive material such that positions of four corners of the sheet-like photosensitive material are different from each other in height, and the sheet-like photosensitive material clips defined in any one of the items (1) to (3) attached on the photosensitive material supporting frame for holding the sheet-like photosensitive material at the four corners, one of the clips being located in the highest position.

(5) A sheet-like photosensitive material hanger for a sheet-like photosensitive material having a photosensitive material supporting frame for obliquely supporting a sheet-like photosensitive material such that positions of four corners of the sheet-like photosensitive material are different from each other in height, and an opening portion for hanging formed in advance to be obliquely supported at one of the four corners which is to be located in the highest position, characterized in that one corner of the sheet-like photosensitive material is hung by a fine hook attached on a photosensitive material supporting frame for obliquely supporting a sheet-like photosensitive material, and three corners of the sheet-like photosensitive material are supported by clips.

(6) A sheet-like photosensitive material having an opening portion located in at least of one corner of the sheet-like photosensitive material, characterized in that a center of the opening portion is located in a range 3 mm×3 mm from the corner.

As preferable embodiments, if a clip is utilized, all clips are preferably the sheet-like photosensitive material according to the above-described in items (1) to (3).

In the clip according to the present invention, one of the pair of opposite forward end portions for clipping a sheet-like photosensitive material therebetween is made to have a planar photosensitive material contacting portion so that no uneven portion is formed as a clip mark in the photosensitive material, unlike a prior art clip. Therefore, the foregoing problem is not caused at the time of formation of a printing plate by using a scanner.

Further, the number of teeth to be formed in the photosensitive material contacting portion of the other forward end portion of the clip, which was not smaller than in the conventional clip, is decreased to be 2 to 4, and the top angle of each tooth is made acute. Therefore, a processing solution hardly remains in spaces among the photosensitive material and the teeth, and hence such dropping of solution as described above is suppressed so that the uneven developing is also prevented. This effect is particularly improved in the case where a corner portion of a sheet-like photosensitive material in the highest position is supported by a fine hook which is formed so as to engage an opening portion formed in that corner of the photosensitive material.

The effect of the present invention is more improved by combining a hook and the clip.

DETAILED DESCRIPTION OF THE PREFERRED EMBODIMENTS

Description will be made below in detail about a sheet-like photosensitive material of the present invention.

It is preferable that the position of the opening portion is located in a square range of 3.0 mm×3.0 mm from the corner of a sheet-like photosensitive material.

Namely, if the opening portion is located in the image inner side the above range, upon taking a picture image by various kinds of holder, it may be possible that the image section is covered to cause a different problem. Further, it is preferable that an opening portion is located at a position nearer the corner, and more preferable is located in a range of 2.0 mm×2.0 mm from a corner. If an opening portion is located at a position at an inner side thereof, it may be possible to be cut off from the opening portion, and it is difficult to control positions of the opening portions in manufacturing. Therefore, it is most preferable that a center of the opening portion is located at a position in a range of between 2.0 mm×2.0 mm and 3.0 mm×3.0 mm from the corner of the photosensitive material.

It is most preferable that a shape of the opening portion is a circle, and a diameter of the circle is from 0.5 mm to 1.5 mm, most preferably from 0.7 mm to 1.3 mm. Further, it is most preferable that the opening portion is located at the nearest position from the notch (indicated by number 106 in FIG. 9).

In view of the ease and the accuracy of opening a sheet-like photosensitive material of the present invention, it is preferable to utilize TAC (triacetate) and PEN (polyethylene-naphthalate) as a supporting body. Further, PEN is preferably subject to annealing in view of strength and its stable dimension. It is preferable that the sheet-like photosensitive material is supported by a transparent material.

Besides, a timing of opening a photosensitive material may be during manufacturing of the photosensitive material or immediately before treatment.

It is preferable that the photosensitive material of the present invention is applied to a sheet-like color negative film and a sheet-like color reversal film. In case of color reversal film, it is most preferable, since uneven developing little occurs. Silver halogenide is the most preferable photosensitive material.

Referring to the accompanied drawings, description will be made below in detail about a sheet-like photosensitive material clip and a sheet-like photosensitive material hanger, according to preferred embodiments of the present invention.

Figure 1:
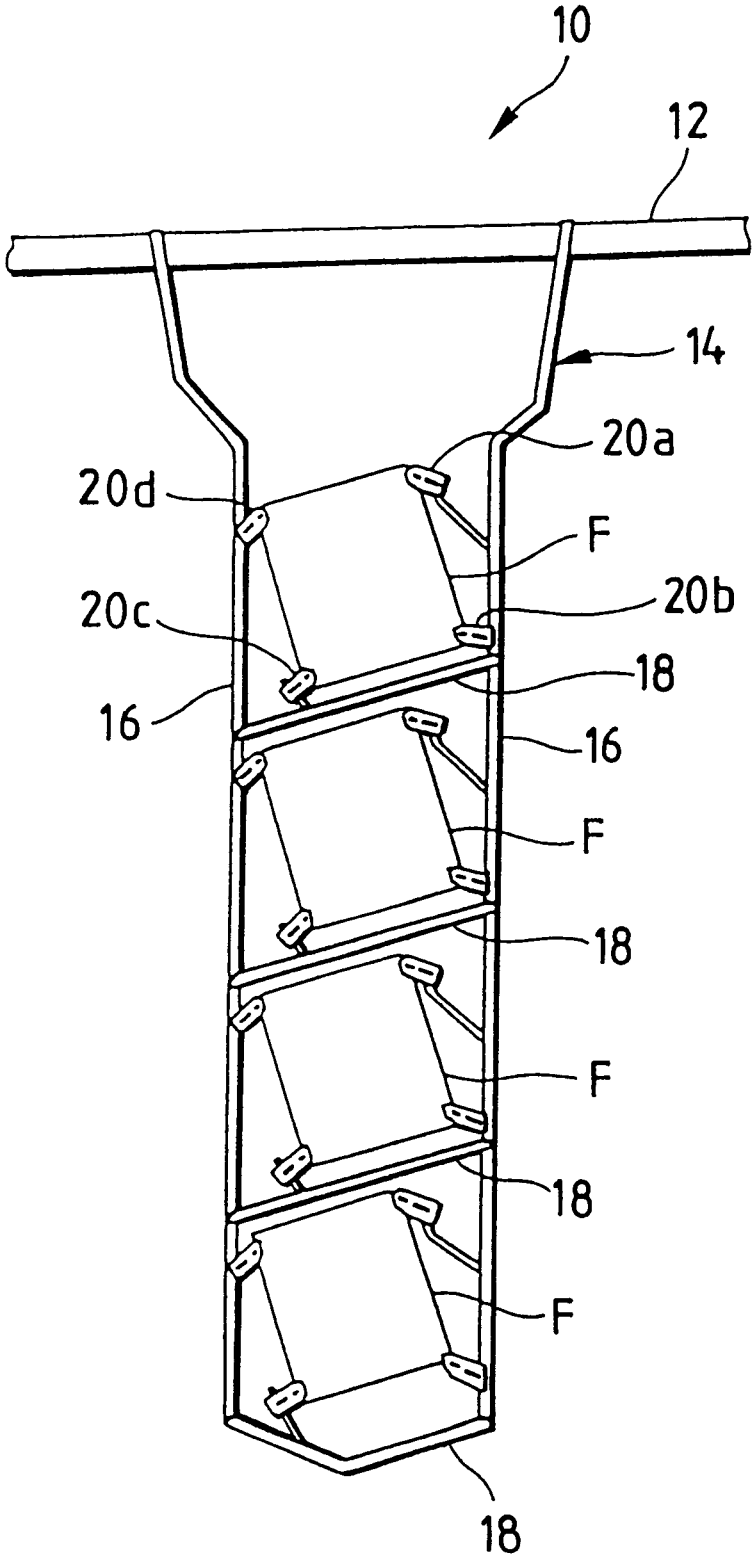
FIG. 1 is a front view of a hanger according to an embodiment of the present invention.

FIG. 1 is a view showing the whole portion of a hanger 10 according to an embodiment of the present invention. The hanger 10 shown in the drawing is of the type which can hold four sheet films F.

The hanger 10 has a carrying crossbar 12 supported at its opposite ends by a carrying apparatus (not shown), a hanger body 14 is hung from the carrying crossbar 12. The hanger body 14 has two vertical bars 16 extending vertically in parallel to each other and a plurality of crossbars 18 stretched between the two vertical bars 16 so as to be slightly inclined from the horizontal state. The hanger body 14 has four clips 20*a*, 20*b*, 20*c*, and 20*d* for clipping one sheet film F. The clips 20*a*, 20*b*, 20*c* and 20*d* are attached on the vertical bars 16 and the crossbars 18, for example, directly by welding or the like, or indirectly through connection bars, so that four corners of each sheet film F are clipped by the clips 20*a*, 20*b*, 20*c*, and 20*d* as shown in FIG. 1. In the clipped state, the sheet film F is inclined as a whole although the sheet plane per se is held substantially vertically as shown in FIG. 1. As a result, the three clips 20*b*, 20*c*, and 20*d* other than the clip 20*a* in the highest position are positioned away from the position of the film F so that even if a processing solution remains in those clips, no-solution is dropped from those clips onto the surface of the film F.

Because all the clips 20*a*, 20*b*, 20*c*, and 20*d* may be identical to each other in shape, the structure of those clips will be described below with those clips referenced by 20 representatively.

Figure 2:
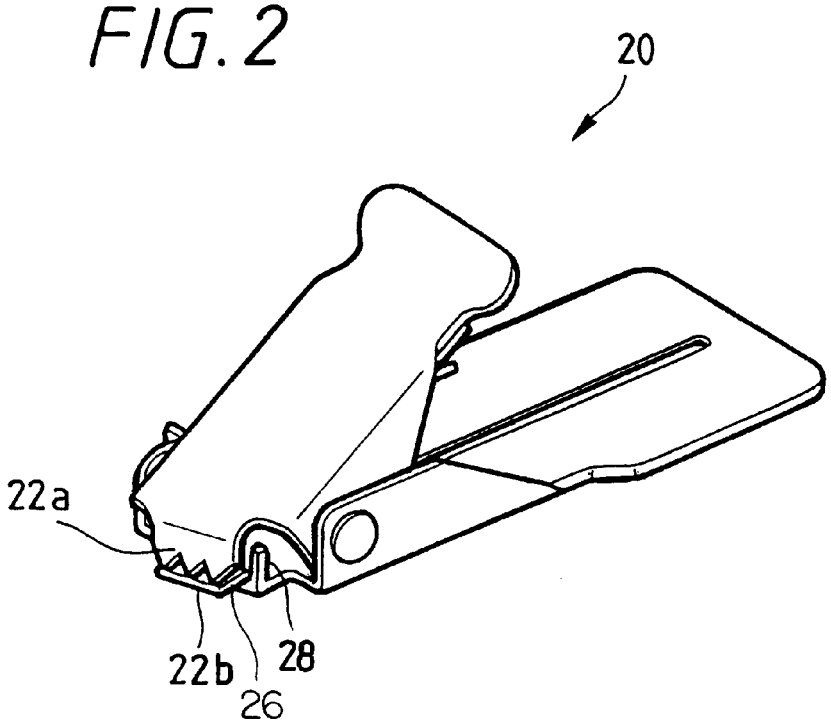
FIG. 2 is a perspective view of the clip according to an embodiment of the present invention.
Figure 3:
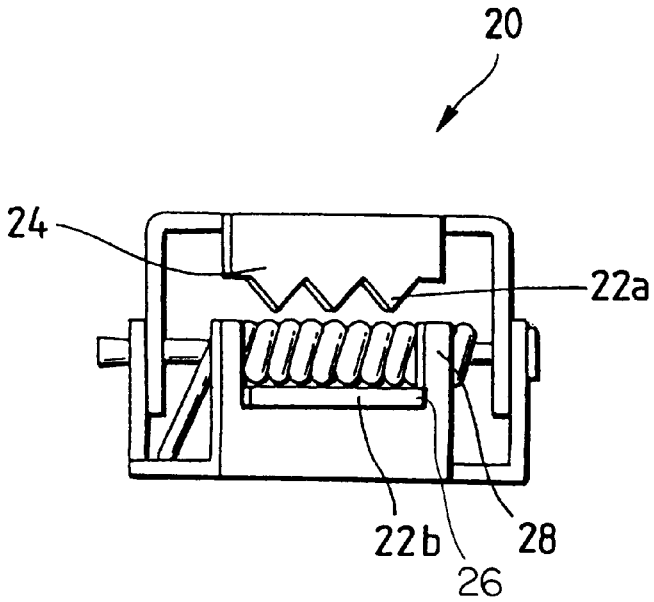
FIG. 3 is a front view of the clip of FIG. 2 in an opened state.
Figure 4:
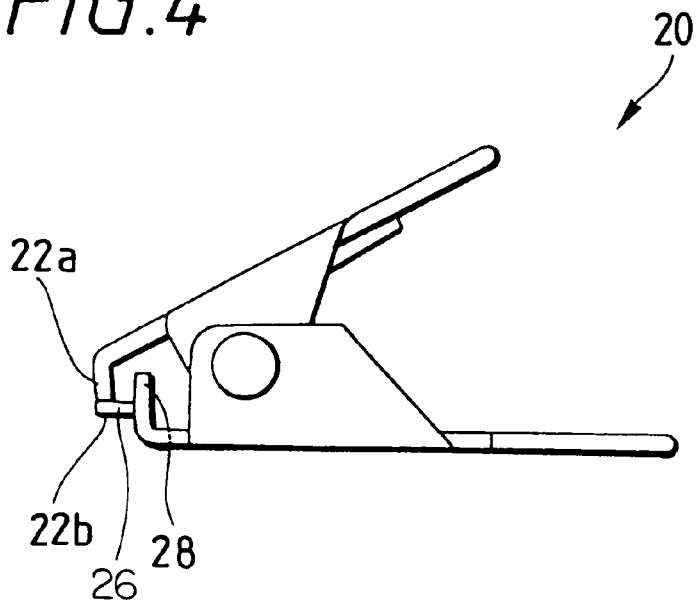
FIG. 4 is a side view of the clip of FIG. 2 in a closed state.
Figure 5:
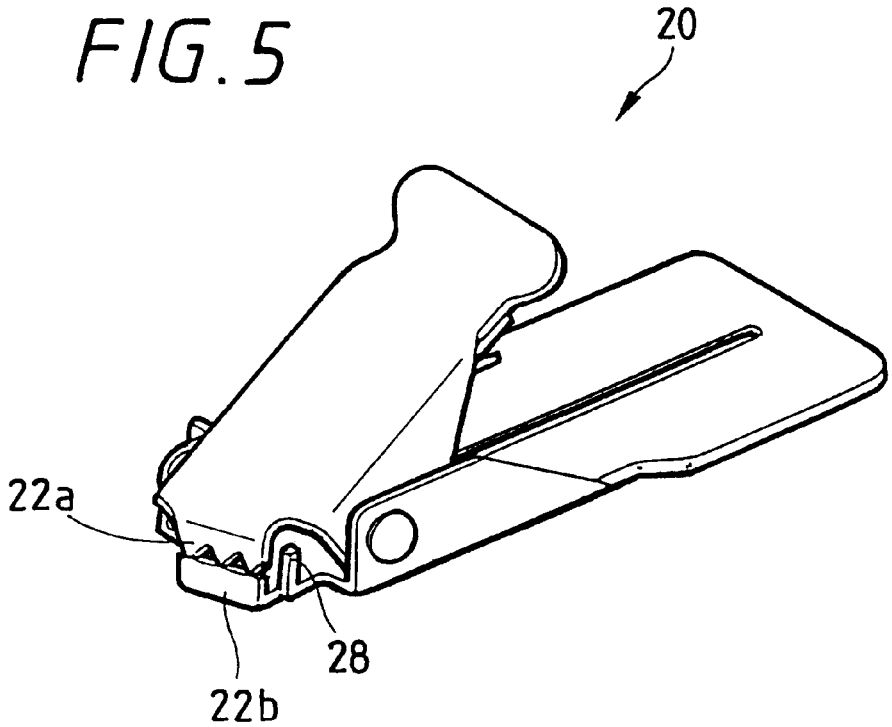
FIG. 5 is a perspective view of a clip according to another embodiment of the present invention.
Figure 6:
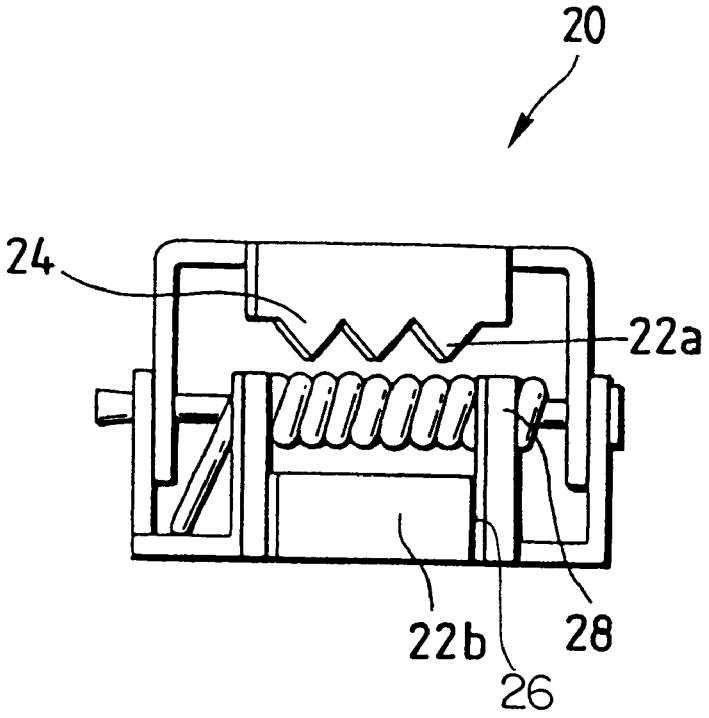
FIG. 6 is a front view of the clip of FIG. 5 in an opened state.

The clip 20 is shaped like a clothespin as a whole as shown in FIGS. 2 and 5, and has a pair of opposite forward end portions 22*a* and 22*b* for clipping a film F therebetween. In the pair of one and the other forward end portions 22*a* and 22*b*, a film-F contacting portion of the one forward end portion 22*a* is shaped like a dentition having a plurality of isosceles-triangular teeth 24 formed in zigzags and, on the other hand, a film-F contacting portion of the other forward end portion 22*b* is formed into a planar portion 26 as shown in FIGS. 3 and 6 shown in the opened state and as shown in FIGS. 2 and 4 in the closed state. As a result, the clip 20 according to the present invention hardly injures the film F with uneven marks or the like even if the clip 20 firmly clips the film F. Accordingly, the succeeding work can be performed very efficiently. In the conventional clip, on the contrary, there was a problem that the film F was injured with uneven marks or the like since both the film-F contacting portions are formed into dentition each having a plurality of teeth formed in zigzags.

Preferably, the number of the teeth 24 is selected to be 2 to 4 and the top angle of each tooth 24 is selected to be acute not larger than 60°. As a result, the processing solution can be prevented from remaining in the clip 20 to the utmost, and hence it is possible to efficiently prevent the uneven developing due to the foregoing dropping of the solution.

Further, it is preferable that the clip 20 according to the present invention has a stopper 28 for preventing the film F from entering the deep inside of the clip, for example, as shown in FIGS. 3 and 6 and FIGS. 4 and 7. Although the stopper 28 shown in the drawings is of the two-stopper type utilizing opposite sides of a standing portion of the forward end portion 22*b*, the stopper 28 may be of the single-stopper type in which the stopper is located at the central portion.

Description of the hanger has been made about the type in which all the four corners of a film F are clipped by the clips 20 according to the foregoing embodiment. In order to further efficiently prevent occurrence of dropping of a solution, alternatively, in a hangar 100 shown in FIG. 8, a corner portion of a film F located in the highest position is hung and held by a fine hook 102 shown in the enlarged state in FIG. 9. In this embodiment, it is necessary that, before a film F is held by the hanger, a small opening 104 (FIG. 9) is formed in advance in the film F at a corner portion thereof which will be located in the highest position. It is preferable to make the opening 104 circular in view of work of formation or the like.

Since it is possible to substantially perfectly prevent a solution from remaining by the function of-the fine hook 102, dropping of the solution due to the remaining of the solution can be substantially perfectly eliminated. Therefore, it is possible to obtain an excellent picture quality having no uneven developing.

As a material of a hook, water-repellent material such as stainless steel is most preferable. Similarly, as a material of a portion in contact with the photosensitive material, water-repellent material is most preferable.

EXAMPLE 1

Photosensitive materials (50 sheets of color reversal film VELVIA produced by Fuji Photo Film Co., Ltd. and 50 sheets of color reversal film EPR produced by Eastman Kodak Co.) were processed and tested of uneven developing by using a color reversal hanger-type film processor (H4R-260D) produced by Noritsu Koki Co., Ltd. and by using the following 5 kinds of sheet film hangers in accordance with FUJICOLOR reversal film processing CR56p. The result is described as below. The supporting body is TAC in each case. The circular shape of 2.50 mm diameter opening is formed at a position of which center is located at a position of 2.5 mm×2.5 mm from the upper corner in the films of D and E.

[A] Conventional hanger for 4×5 sheets (produced by Noritsu Koki Co., Ltd.)

[B] Hanger in which each of 4 clip portions has a structure of FIGS. 2 to 4 (the number of teeth is 3 and the top end angle of each tooth is 20°: the structure of teeth applies to the following).

Figure 7:
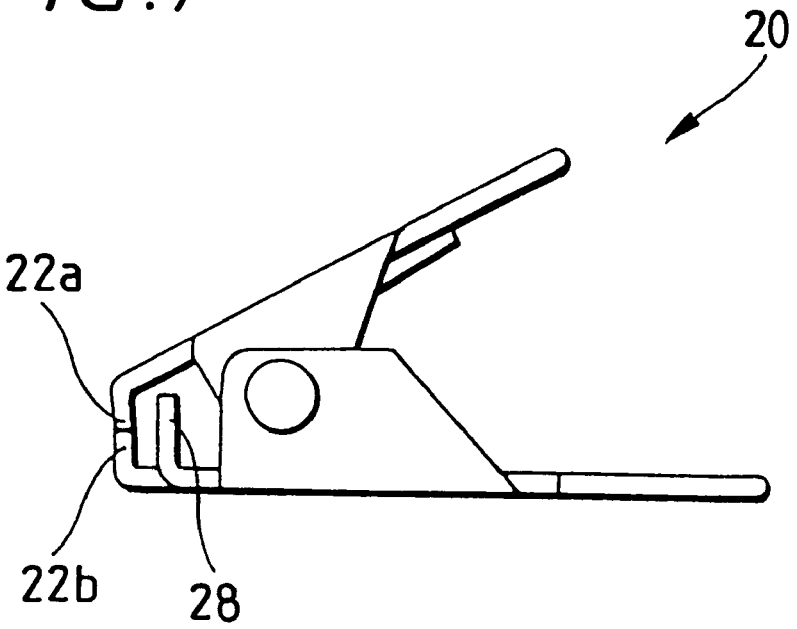
FIG. 7 is a side view of the clip of FIG. 5 in a closed state.

[C] Hanger in which each of 4 clip portions has a structure of FIGS. 5 to 7.

Figure 8:
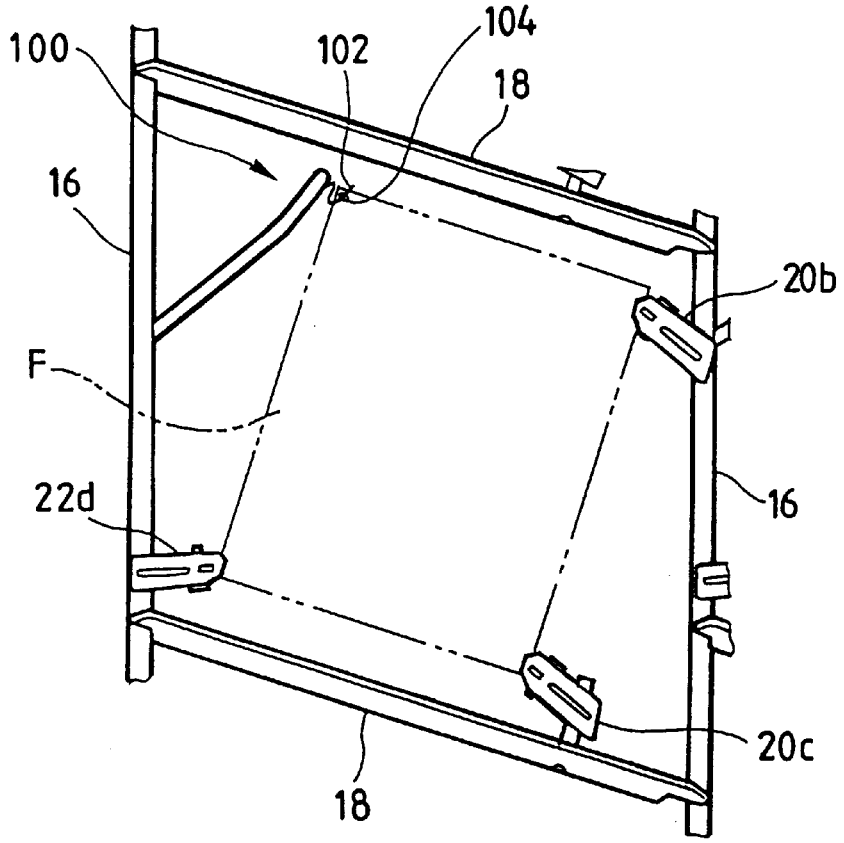
FIG. 8 is a view showing a modification of the hanger according to the embodiment of the present invention.
Figure 9:
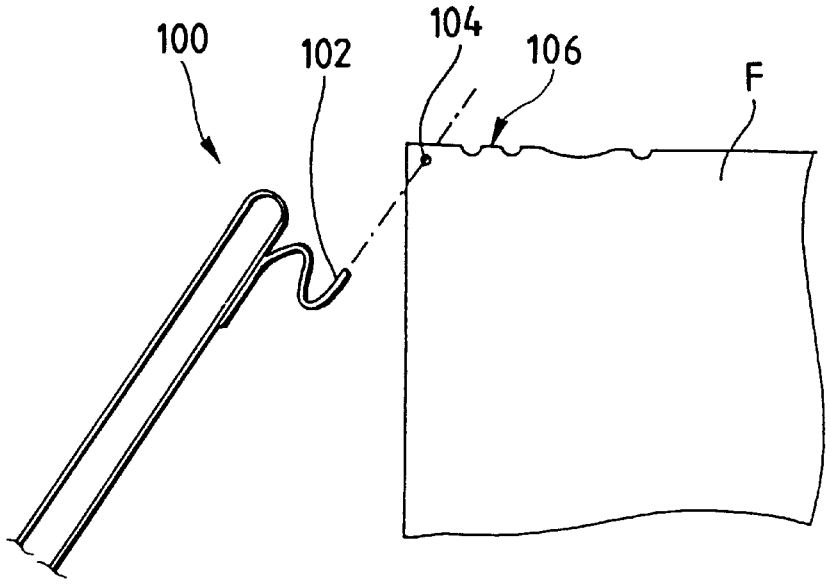
FIG. 9 is an enlarged view for explaining a main portion of the hanger shown in FIG. 8.

[D] Hanger in which the highest position of the clip portions has a structure of FIGS. 8 to 9, while the other three conventional clips are used in the other positions.

[E] Hanger in which the highest position of the clip portions has a structure of FIGS. 8 to 9, while the other three clips in the other positions have the structure of FIGS. 5 to 7.

| Hanger | Uneven developing (due to dropping) The number of uneven samples/100 samples |
|---|---|
| A (comparison) | 12/100 |
| B (Present invention) | 1/100 |
| C (Present invention) | 1/100 |
| D (Present invention) | 0/100 |
| E (Present invention) | 0/100 |

In the hanger B, C, and D, since the evenness of the photosensitive material is maintained, the characteristics read by a color scanner is improved.

EXAMPLE 2

In the hanger B of Example 1, uneven developing (due to dropping) of films and scratches in the emulsion surfaces at the time of attachment of films were examined by changing the number of the teeth 22*a* (100 sheets were processed in the same manner as Example 1).

| The number of teeth | Scratch in film emulsion surface | Uneven developing (due to dropping) |
|---|---|---|
| 1 | 6 sheets/100 sheets | 0 sheet/100 sheets |
| 2 | 1 sheet/100 sheets | 0 sheet/100 sheets |
| 3 | 0/100 sheets | 0 sheet/100 sheets |
| 4 | 0/100 sheets | 1 sheet/100 sheets |
| 5 | 1 sheet/100 sheets | 2 sheets/100 sheets |
| 6 | 1 sheet/100 sheets | 3 sheets/100 sheets |

The effects of the present invention are apparent from the foregoing examples.

What is claimed is:

1. A sheet-like photosensitive material clip for use in a hangar-like film processor comprising:

a pair of opposite forward end portions for clipping a sheet-like photosensitive material therebetween, wherein a first photosensitive material contacting portion at one of said forward end portions is formed to be planar, and a second photosensitive material contacting portion of the other of said forward end portions is formed like a dentition having a plurality of teeth formed in zigzag;

wherein said teeth of said second photosensitive material contacting portion are formed without interruption entirely along said forward end portion.

2. The sheet-like photosensitive material clip of claim 1, wherein a stopper is formed to prevent a photosensitive material from entering an inside of said clip.

3. The sheet-like photosensitive material clip of claim 1, wherein a top end angle of each of said teeth is not larger than 60°, and a number of said teeth is selected to be 2 to 4.

4. The sheet-like photosensitive material hanger assembly comprising:

a photosensitive material supporting frame for obliquely supporting a sheet-like photosensitive material such that positions of four corners of said sheet-like photosensitive material are different from each other in height, and said sheet-like photosensitive material clips of claim 1 attached on said photosensitive material supporting frame for holding the sheet-like photosensitive material at the four corners, one of said clips being located in a highest position.

5. A sheet-like photosensitive material hangar assembly according to claim 4, further comprising:

a sheet-like photosensitive material; and an opening portion located in at least one corner of said sheet-like photosensitive material, wherein a center of said opening portion is located in a range 3 mm×3 mm from said corner.

6. The sheet-like photosensitive material hangar assembly of claim 5, wherein the sheet-like photosensitive material is silver halogenide.

7. The sheet-like photosensitive material hangar assembly of claim 5, wherein the sheet-like photosensitive material is supported by a transparent material.

8. The sheet-like photosensitive material hanger according to claim 4, wherein said clips comprise:

a pair of opposite forward end portions for clipping a sheet-like photosensitive material therebetween, wherein a first photosensitive material contacting portion at one of said forward end portions is formed to be planar, and a second photosensitive material contacting portion of the other of said forward end portions is formed like a dentition having a plurality of teeth formed in zigzags.

9. The sheet-like photosensitive material clip according to claim 8, wherein a stopper is formed to prevent a photosensitive material from entering an inside of said clip.

10. The sheet-like photosensitive material clip according to claim 8, wherein a top end angle of each of said teeth is not larger than 60°, and a number of said teeth is selected to be 2 to 4.

11. A sheet-like photosensitive material hanger for a sheet-like photosensitive material comprising:

a photosensitive material supporting frame for obliquely supporting a sheet-like photosensitive material such that positions of four corners of said sheet-like photosensitive material are different from each other in height, and an opening portion for hanging formed in advance to be obliquely supported at one of the four corners which is to be located in a highest position, wherein one corner of said sheet-like photosensitive material is hung by a fine hook attached on a photosensitive material supporting frame for obliquely supporting a sheet-like photosensitive material, and three corners of said sheet-like photosensitive material are supported by clips.

12. The sheet-like photosensitive material hanger according to claim 11, wherein said hook is formed of a water-repellent material.

13. The sheet-like photosensitive material hanger according to claim 11, wherein a portion of said hook in contact with said photosensitive material is formed of a water-repellent material.

14. The sheet-like photosensitive material hanger according to claim 12, wherein said water-repellent material is stainless steel.

15. The sheet-like photosensitive material hanger according to claim 11, wherein said clips comprise:

a pair of opposite forward end portions for clipping a sheet-like photosensitive material therebetween, wherein a first photosensitive material contacting portion at one of said forward end portions is formed to be planar, and a second photosensitive material contacting portion of the other of said forward end portions is formed like a dentition having a plurality of teeth formed in zigzags.

16. The sheet-like photosensitive material clip according to claim 15, wherein a stopper is formed to prevent a photosensitive material from entering an inside of said clip.

17. The sheet-like photosensitive material clip according to claim 15, wherein a top end angle of each of said teeth is not larger than 60°, and a number of said teeth is selected to be 2 to 4.

* * * * *